US007150051B2

(12) United States Patent
Schlief

(10) Patent No.: US 7,150,051 B2
(45) **Date of Patent: *Dec. 19, 2006**

(54) DEVICE FOR GENERATING A MASSAGE STREAM IN A SANITARY TUB

(75) Inventor: Dirk Schlief, Dülmen (DE)

(73) Assignee: Franz Kaldewei GmbH & Co. KG, Ahlen (DE)

( * ) Notice: Subject to any disclaimer, the term of this patent is extended or adjusted under 35 U.S.C. 154(b) by 230 days.

This patent is subject to a terminal disclaimer.

(21) Appl. No.: 10/928,809

(22) Filed: Aug. 27, 2004

(65) Prior Publication Data

US 2005/0241059 A1 Nov. 3, 2005

(30) Foreign Application Priority Data

Apr. 30, 2004 (DE) ..... 10 2004 021 470

(51) Int. Cl.
*A61H 33/04* (2006.01)

(52) U.S. Cl. ..... 4/541.6

(58) Field of Classification Search ..... 4/541.1–541.6
See application file for complete search history.

(56) References Cited

U.S. PATENT DOCUMENTS 5,056,168 A * 10/1991 Mersmann ..... 4/541.6
5,063,620 A * 11/1991 Mersmann ..... 4/541.6
5,335,376 A * 8/1994 Kaldewei ..... 4/541.6
6,065,161 A 5/2000 Mateina et al.
6,991,182 B1 * 1/2006 Chen ..... 239/251

FOREIGN PATENT DOCUMENTS

DE 198 34 341 2/2000

* cited by examiner

*Primary Examiner*—Charles E. Phillips
(74) *Attorney, Agent, or Firm*—Collard & Roe, P.C.

(57) ABSTRACT

A device for generating a massage stream in a sanitary tub has an accommodation device that can be attached to an opening in the tub body of the sanitary tub, for accommodating an electric motor having a drive shaft, a propeller having a hub attached to the drive shaft and vanes arranged radially about the hub. There is a rosette arranged on the accommodation device, positioned within the sanitary tub, having edge-side inflow openings, as well as a central outlet opening. The propeller draws water located in the sanitary tub in through the inflow openings, and subsequently transports it back into the sanitary tub, through a guide element arranged in the outlet opening, which can be pivoted relative to the hub axis. The guide element is configured as a guide vane ring and has a ring-shaped bearing shell at the outer end of the guide vanes. The shell moves between a glide surface of the accommodation device that is configured as a sphere surface segment, and a concave contact surface of the rosette.

8 Claims, 5 Drawing Sheets

21
25
22
16
14
26
17
28
24
y
23

17
27
28
16
14

Fig. 4a
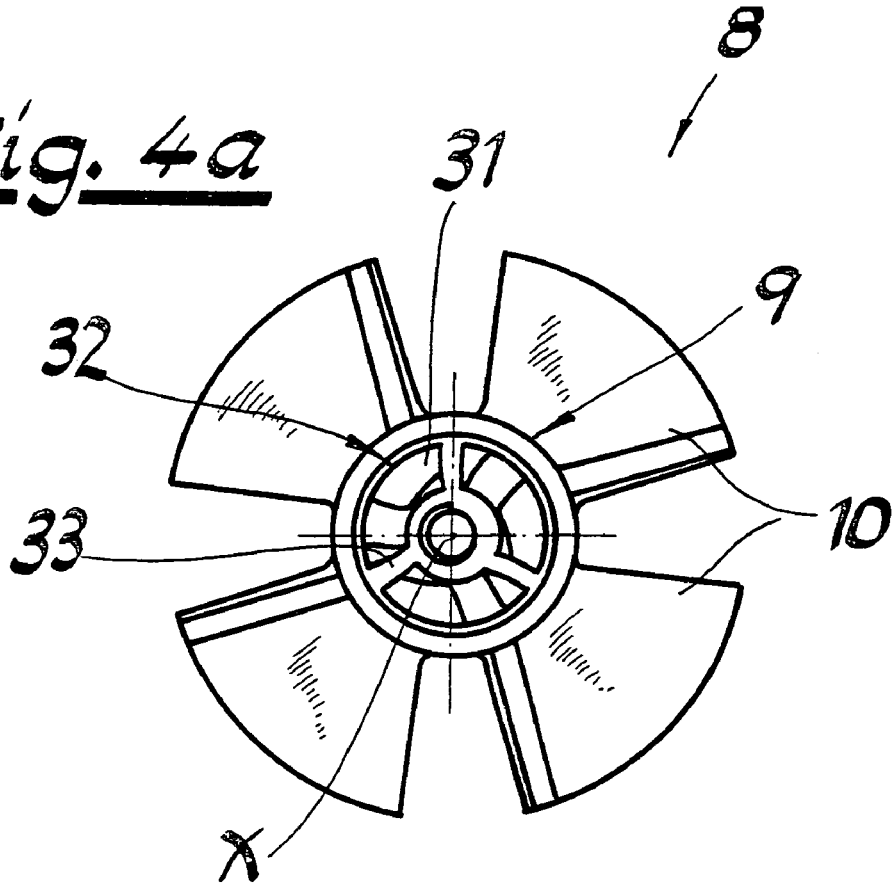
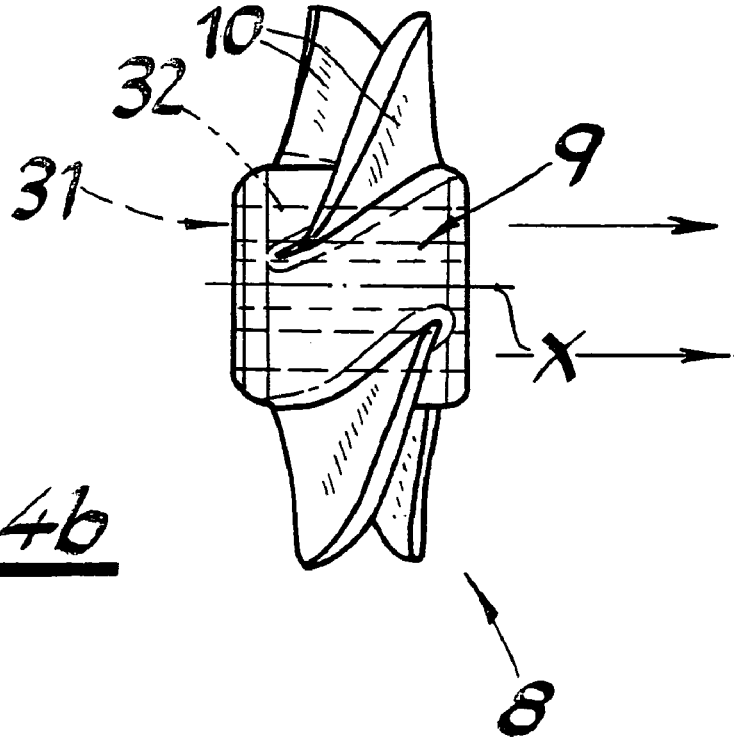
Fig. 4b

DEVICE FOR GENERATING A MASSAGE STREAM IN A SANITARY TUB

BACKGROUND OF THE INVENTION

1. Field of the Invention

The invention relates to a device for generating a massage stream in a sanitary tub. In particular, the invention relates to a device having an accommodation device that can be attached to an opening in the tub body of the sanitary tub for accommodating an electric motor having a drive shaft, a propeller having a hub attached to the drive shaft and vanes arranged radially about the hub, and a rosette arranged on the accommodation device, positioned within the sanitary tub, having edge-side inflow openings, as well as a central outlet opening. The propeller draws water located in the sanitary tub in through the inflow openings, and subsequently transports it back into the sanitary tub, through a guide element arranged in the outlet opening, which can be pivoted relative to the hub axis.

2. The Prior Art

A device having the characteristics described above is discussed in German Patent No. DE 198 34 341 C2. In this patent, the guide element is configured as a bell having an exit end that narrows in a jet shape and the propeller is arranged within the bell. The arrangement is complicated in terms of design and assembly technology. Furthermore, the relatively small exit cross-section for the massage jet is unsatisfactory.

SUMMARY OF THE INVENTION

It is therefore an object of the invention to provide a device which allows setting the direction of the stream of water exiting from the device, without a jet-shaped narrowing of the flow cross-section. It is another object of the invention to provide a device that is structured in a simple manner in terms of design, and is easy to assemble.

This object is accomplished according to the invention by a device having a guide element that is configured as a guide vane ring and has a ring-shaped bearing shell at the outer end of the guide vanes, which shell is held in place, so as to move, between a glide surface of the accommodation device that is configured as a sphere surface segment, and a concave contact surface of the rosette. The guide vane ring guarantees precise deflection of the massage jet that exits from the device, into the desired direction, even at great pivot angles. During assembly, the guide element is simply set upon the sphere surface segment, and the rosette is subsequently screwed onto the accommodation device. Preferably, the rosette has a ring-shaped connection ridge provided with an inside thread and an outside thread, which interacts with an attachment ridge on the accommodation device and attaches the rosette on the accommodation device. By appropriate tightening of the screw connection, the clamping force of the guide vane ring can be precisely adjusted. The bearing shell can comprise a sleeve that interacts with the sphere surface segment and is fitted into an accommodation ring of the bearing shell that is molded onto the outer ends of the guide vanes. Preferably, the guide vane ring has an inner ring having a center passage opening, onto which the guide vanes are molded on, on the outside. Flow guide elements can be arranged in the passage opening of the inner ring, which elements are molded onto the inner ring. The flow guide elements contribute to rectification of the flow as it flows through the passage opening, and hereby guide the flow into a direction parallel to the axis of the guide vane ring. The flow guide elements themselves, in turn, can comprise a ring-shaped ridge having a wall thickness that increases in the flow direction, so that the flow is correspondingly accelerated in this region. A displacement profile, the thickness of which also increases in the flow direction, can be arranged in the center, within this ridge. The guide vanes, the ring-shaped ridges, as well as the flow guide elements can be configured as a one-piece injection-molded part.

Preferably, the pivot position can be changed via pressure on the guide vane ring, and the guide vane ring remains in a desired position because of its elastic behavior. The elastic behavior is achieved by selecting an appropriately suitable material of the sleeve and/or of the remainder of the guide vane ring. Preferably, the rosette is structured in multiple parts, and has an outer ring provided with the inflow openings, as well as an inner attachment ring having the outlet opening, which is connected with the outer ring.

According to a preferred embodiment of the invention, a flow channel for simultaneously drawing in ambient air, using the propeller, is provided in the accommodation device. The air flows through an air channel arranged in the hub after leaving the flow channel, and flows through the outlet opening together with the stream of water. Fan blades are provided within the air channel, which promote the intake of air. Preferably, the air channel is configured to be ring-shaped and concentric to the hub axis. A reflux preventer can be provided ahead of the air inflow opening of the flow channel, to which an air intake tap is connected upstream. The air feed can preferably be optionally turned on and off by a valve connected to an operating element, or a separate rotary knob.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views:

FIG. 4*a*, 4*b* show a view A of the propeller shown in FIG. 1, as well as a side view of the propeller.

DETAILED DESCRIPTION OF THE PREFERRED EMBODIMENT

Figure 1:
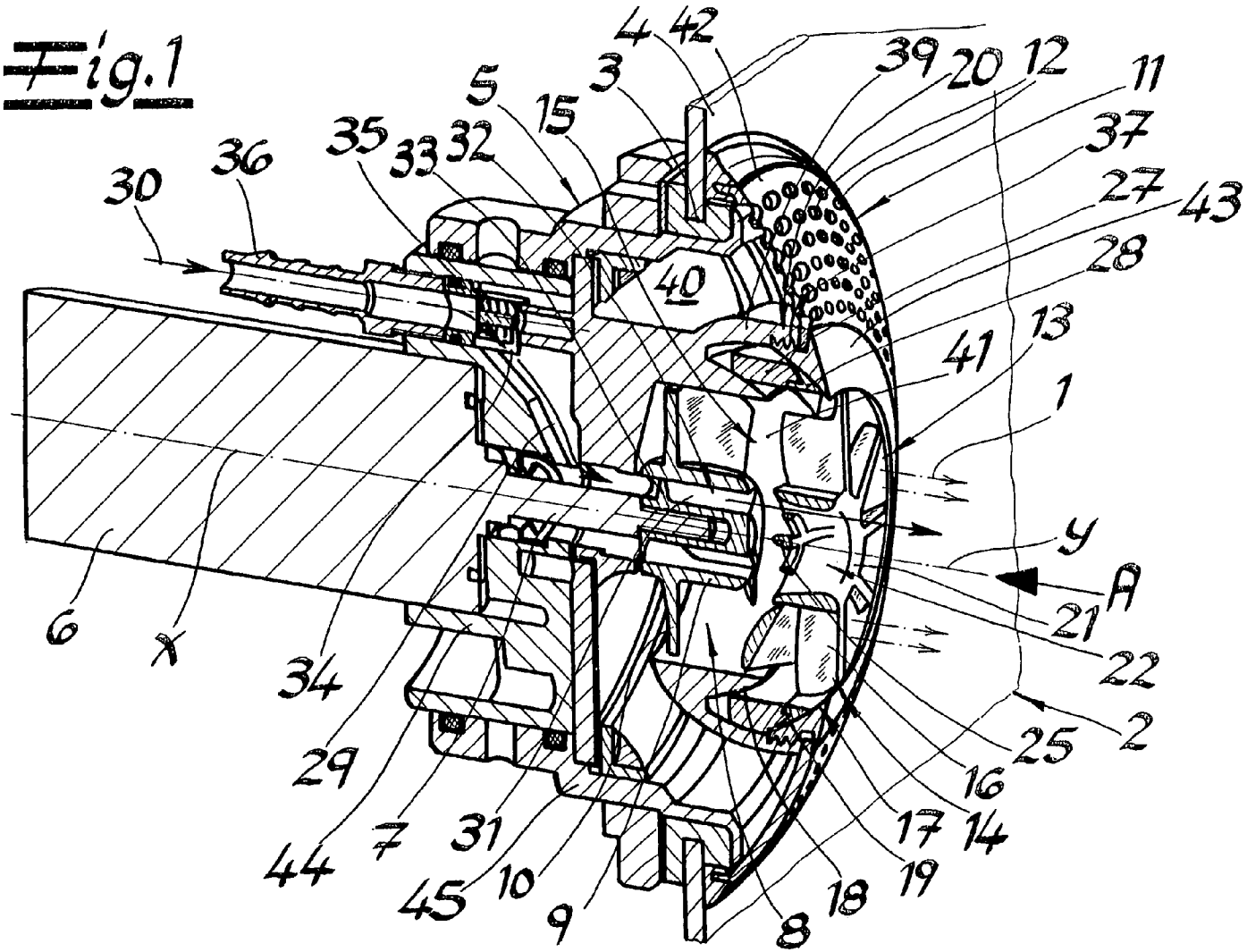
FIG. 1 shows a device according to the invention, in a three-dimensional cross-sectional view with propeller and guide vane ring.

Referring now in detail to the drawings, the figures show a device for generating a massage stream 1 in a sanitary tub 2, having an accommodation device 5 that can be attached to an opening 3 in tub body 4, to accommodate an electric motor 6 having a drive shaft 7, a propeller 8 having a hub 9 attached to the drive shaft 7 in overhung manner. There are vanes 10 arranged radially about hub 9, and a rosette 11 arranged on the accommodation device 5, positioned within sanitary tub 2, having edge-side inflow openings 12, as well as a center outlet opening 13. Rosette 11 is configured in two parts and comprises an outer ring 42 having inflow openings 12, as well as an inner attachment ring 43 having outlet opening 13, which is connected with outer ring 42. Propeller 8 draws in water located in sanitary tub 2, through inflow openings 12, and subsequently transports the water back into sanitary tub 2 through a guide element 14 arranged in outlet opening 13, which element can pivot relative to hub axis X. Accommodation device 5 has a flow space 15 to guide the stream of water that has been drawn in.

Accommodation device 5 is furthermore configured in multiple parts and has a motor accommodation 44 as well as a bearing shield 45 that can be attached to tub body 4, which is connected with motor accommodation 44. Guide element 14 is configured as a guide vane ring and has a ring-shaped bearing shell 17 on the outer end of guide vanes 16, which shell is held in place, so as to move, between a glide surface of accommodation device 5 that is configured as a sphere surface segment 18, and a concave contact surface 19 of attachment ring 43. Attachment ring 43 of rosette 11 is connected with accommodation device 5 by a screw connection 20. Here, attachment ring 43 has an outside thread 37 that interacts with an attachment ridge 39 on accommodation device 5, and attaches rosette 11 to accommodation device 5. At the same time, ridge 39 causes a division of flow space 15 into an inflow channel 40 that follows inflow openings 12, and an outlet channel 41 for massage stream 1, which is arranged upstream from outlet opening 13. By means of appropriate tightening of screw connection 20, the clamping force of guide vane ring 14 can be precisely adjusted.

Guide vane ring 14 has an inner ring 21 having a center passage opening 22, onto which guide vanes 16 are molded on, on the outside. Flow guide elements 23 are molded onto the inside of inner ring 21 (see FIGS. 3*a* and 3*c*). Flow guide elements 23 contribute to rectification of massage stream 1 as it flows through passage opening 22, and deflect stream 1 into a direction parallel to axis Y of guide vane ring 14, in passage opening 22. Flow guide elements 23 comprise a ring-shaped ridge 24, the profile thickness of which increases in the flow direction. On the inside of ring-shaped ridge 24, a displacement profile 25, the thickness of which also increases in the flow direction (FIG. 1), is molded on.

Figure 2:
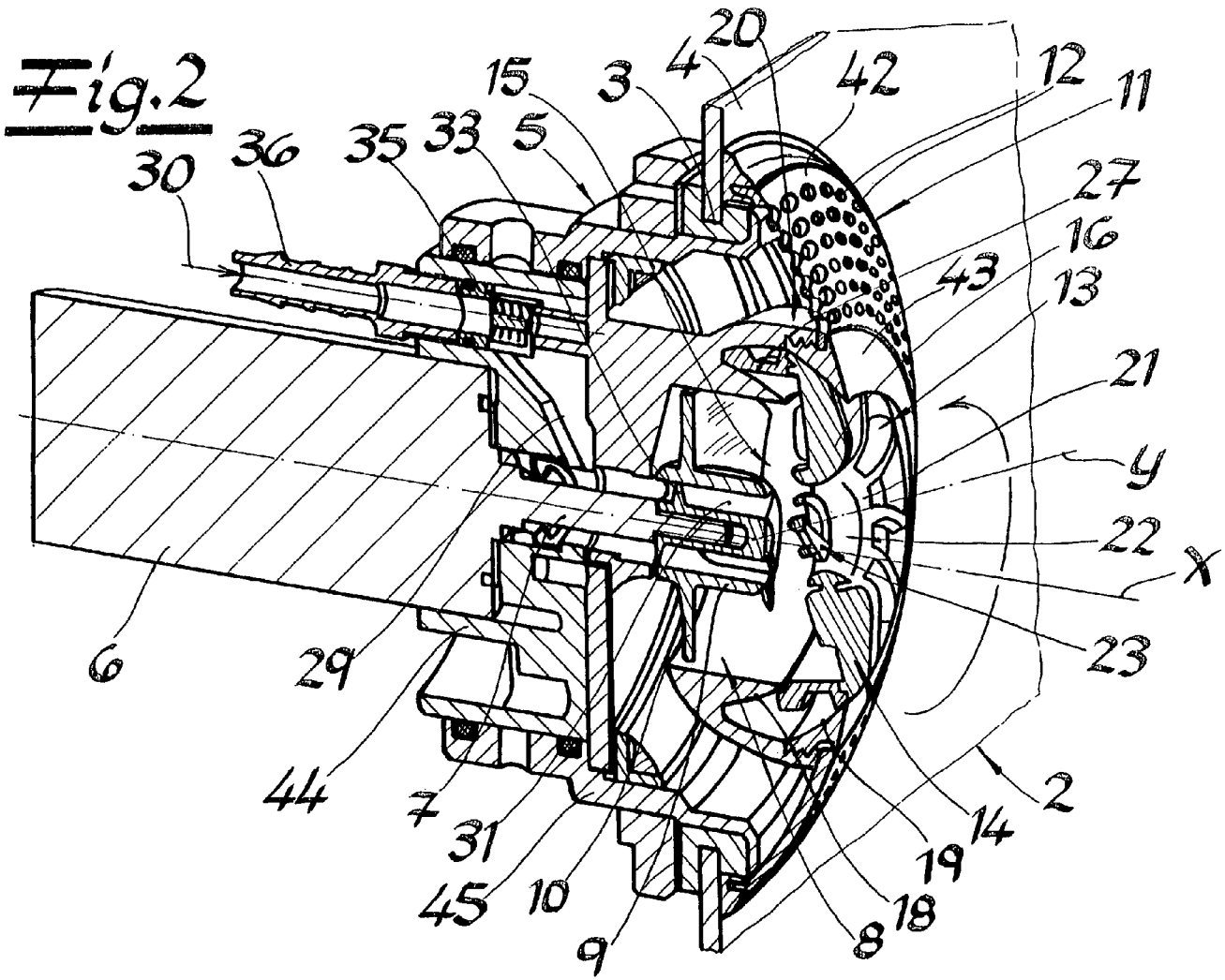
FIG. 2 shows the device according to FIG. 1 with the guide vane ring pivoted into another position.
Figure 3A:
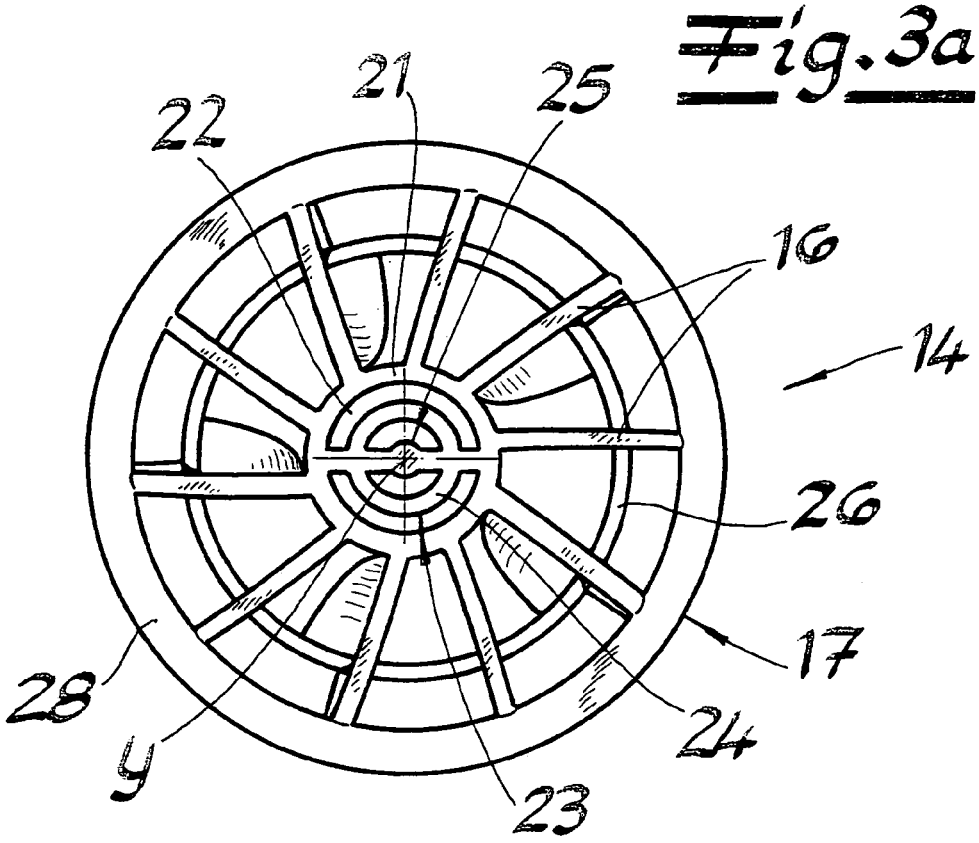
FIG. 3*a*–3*d* show a view A of the guide vane ring shown in FIG. 1, as well as a side view and two three-dimensional representations of this component.
Figure 3B:
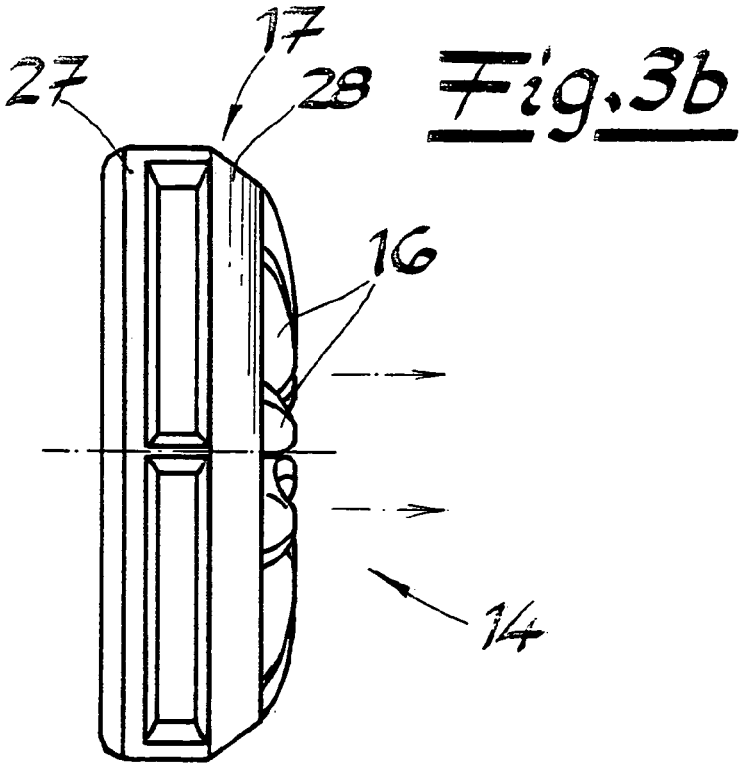
Figure 3C:
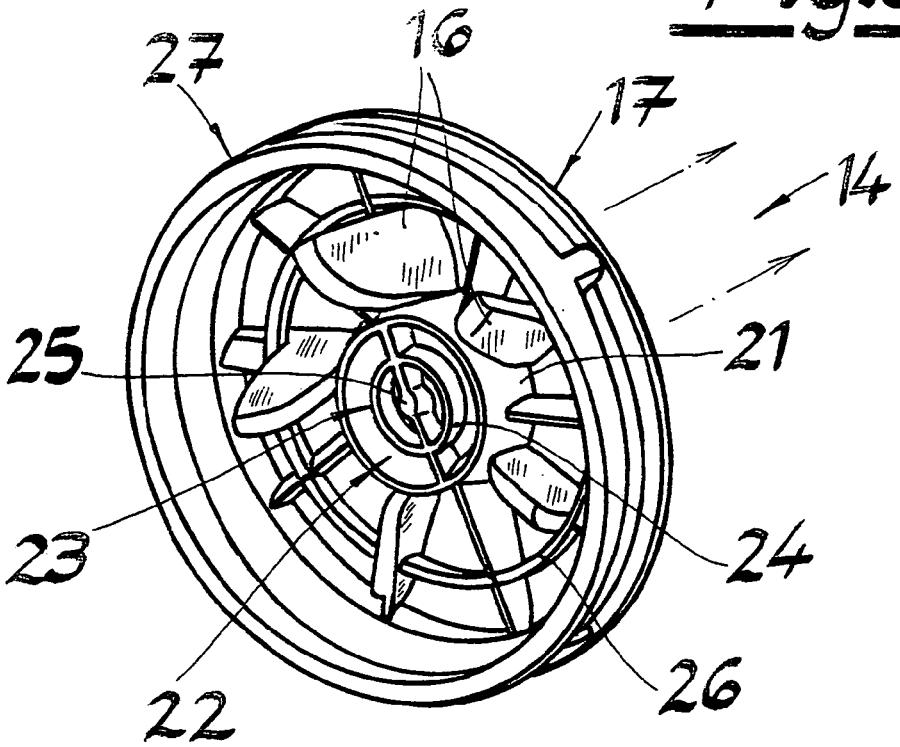
Figure 3D:
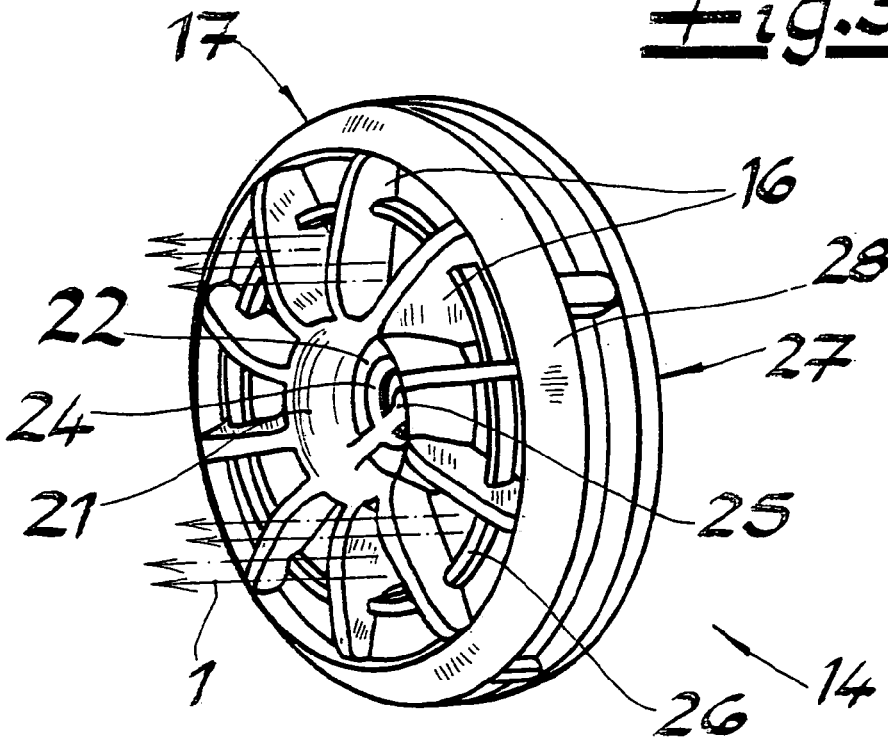

FIGS. 3*a*, 3*c*, and 3*d* show that guide vanes 16 are partly set at a slant to the main flow direction, and make a transition to an axial orientation in the flow direction. In the exemplary embodiment, every other guide vane 16 is configured in this manner. Furthermore, in the center diameter region of guide vane ring 14, a circumferential reinforcement ring 26 is molded onto guide vanes 16. From a comparison of FIGS. 1 and 2, it is evident that the pivot position can be changed by means of pressure on guide vane ring 14, and that guide vane ring 14 remains in a desired position because of its elastic behavior. For this purpose, bearing shell 17 comprises an elastic sleeve 27, which interacts with sphere surface segment 18 and is fitted into an accommodation ring 28 of bearing shell 17 molded onto the outer ends of guide vanes 16, in one piece (see FIGS. 1 and 3*b*).

FIGS. 1 and 2 furthermore show that a flow channel 29 for simultaneously drawing in ambient air 30, using propeller 8, is provided in accommodation device 5. The air 15 flows through a ring-shaped air channel 31, concentric to the hub axis X, arranged in hub 9, after leaving flow channel 29, and flows through outlet opening 13 together with the stream of water (see FIG. 4*b*). Air channel 31 has fan blades 33 that promote the intake of air 30, within ring gap 32 (see FIGS. 1 and 4*a*). A reflux preventer 35 is provided ahead of air inflow opening 34 of flow channel 29, to which an air intake tap 36 is connected upstream. The air feed can be optionally turned on and off by means of a valve connected to an operating element (not shown).

Accordingly, while only a few embodiments of the present invention have been shown and described, it is obvious that many changes and modifications may be made thereunto without departing from the spirit and scope of the invention.

What is claimed is:

1. A device for generating a massage stream in a sanitary tub having a tub body, comprising:

an accommodation device that can be attached to an opening in the tub body of the sanitary tub, said accommodation device accommodating an electric motor having a drive shaft;

a propeller having a hub attached to the drive shaft and vanes arranged radially about the hub; and a rosette arranged on the accommodation device, said rosette having edge-side inflow openings, as well as a central outlet opening; and a guide element arranged in the outlet opening and comprising a guide vane ring having a ring-shaped bearing shell at an outer end of guide vanes, wherein said shell moves between a glide surface of the accommodation device that is configured as a sphere surface segment, and a concave contact surface of the rosette;

wherein when the device is installed in a sanitary tub, the propeller draws water located in the sanitary tub in through the inflow openings, and subsequently transports the water back into the sanitary tub, through the guide element, which can be pivoted relative to a hub axis (X).

2. The device according to claim 1, wherein the rosette has a ring-shaped connection ridge provided with an inside thread or an outside thread, which interacts with an attachment ridge on the accommodation device and attaches the rosette on the accommodation device.

3. The device according to claim 1, wherein the bearing shell comprises a sleeve that interacts with the sphere surface segment and is fitted into an accommodation ring of the bearing shell that is molded onto outer ends of the guide vanes.

4. A device according to claim 1, wherein the guide vane ring has an inner ring having a center passage opening, and wherein said guide vanes are molded onto an outside of said inner ring.

5. A device according to claim 4, further comprising flow guide elements arranged in the passage opening of the inner ring, which are molded onto the inner ring.

6. A device according to claim 1, wherein the rosette is configured in multiple parts and has an outer ring having the inflow openings, as well as an inner attachment ring having the outlet opening, said inner attachment ring being connected with the outer ring.

7. A device according to claim 1, further comprising a flow channel for drawing in air and being disposed in the accommodation device, wherein the air flows through an air channel arranged in the hub of the propeller after leaving the flow channel, and flows through the outlet opening together with a stream of water, and wherein fan blades are provided within the air channel, which promote the intake of air.

8. A device according to claim 7, wherein the air channel is ring-shaped and concentric to the hub axis.

* * * * *